US006080706A

United States Patent [19]

Blanvalet et al.

[11] Patent Number: 6,080,706

[45] Date of Patent: Jun. 27, 2000

[54] ALL PURPOSE LIQUID CLEANING COMPOSITIONS

[75] Inventors: Claude Blanvalet, Angleur; Yves Lambremont, Rocourt, both of Belgium

[73] Assignee: Colgate Palmolive Company, New York, N.Y.

[21] Appl. No.: 09/239,264

[22] Filed: Jan. 29, 1999

Related U.S. Application Data

[63] Continuation-in-part of application No. 09/105,574, Jun. 26, 1998, abandoned, which is a continuation-in-part of application No. 08/729,474, Oct. 11, 1996, abandoned.

[51] Int. Cl.[7] ..... C11D 1/722; C11D 3/43; C11D 3/48; C11D 3/50

[52] U.S. Cl. ..... 510/108; 510/238; 510/245; 510/362; 510/365; 510/382; 510/384; 510/386; 510/405; 510/417; 510/421; 510/504; 510/506

[58] Field of Search ..... 510/108, 238, 510/245, 362, 365, 382, 384, 386, 405, 506, 417, 421, 504

[56] References Cited

U.S. PATENT DOCUMENTS

| | | | |
|---|---|---|---|
| 3,953,352 | 4/1976 | Mizutani et al. | 510/276 |
| 4,013,579 | 3/1977 | Nakasone et al. | 510/405 |
| 4,597,887 | 7/1986 | Colodney et al. | 134/2 |
| 5,076,954 | 12/1991 | Loth et al. | 134/40 |
| 5,108,643 | 4/1992 | Loth et al. | 510/238 |
| 5,185,145 | 2/1993 | Eggensperger et al. | 424/78.08 |
| 5,435,935 | 7/1995 | Kupneski | 510/384 |
| 5,591,708 | 1/1997 | Richter | 510/463 |
| 5,643,861 | 7/1997 | De Guertechin et al. | 510/365 |
| 5,665,689 | 9/1997 | Durbut | 510/365 |
| 5,719,113 | 2/1998 | Fendler et al. | 510/382 |
| 5,731,282 | 3/1998 | Duquesne | 510/423 |
| 5,861,367 | 1/1999 | Blanvelet et al. | 510/365 |
| 5,911,915 | 6/1999 | Fonsny et al. | 252/312 |

FOREIGN PATENT DOCUMENTS

| | | |
|---|---|---|
| 95/00613 | 1/1995 | WIPO . |

*Primary Examiner*—Lorna M. Douyon
*Attorney, Agent, or Firm*—Richard E. Nanfeldt

[57] ABSTRACT

An improvement is described in compositions which is especially effective in disinfecting the surface being cleaned and in the removal of oily and greasy soil which contains at least one nonionic surfactant, a hydrocarbon ingredient, a water soluble solvent, a bactericide and water.

4 Claims, No Drawings

ALL PURPOSE LIQUID CLEANING COMPOSITIONS

RELATED APPLICATION

This application is a continuation in part application of U.S. Ser. No. 9/105,574 filed Jun. 26, 1998 now abandoned which in turn is a continuation in part application of U.S. Ser. No. 8/729,474 filed Oct. 11, 1996 now abandoned.

FIELD OF THE INVENTION

This invention relates to an improved all-purpose liquid cleaner designed in particular for cleaning and disinfecting hard surfaces and which is effective in removing grease soil and/or bath soil and in leaving unrinsed and disinfected surfaces with a shiny appearance.

BACKGROUND OF THE INVENTION

British Patent No 1,453,385 discloses polyesterified nonionic surfactants similar to the polyesterified nonionic surfactants of the instant invention. However, these nonionic surfactants of British Patent 1,453,385 do not disclose the formula (II) portion of the instant composition. Additionally, the formulated compositions of British Patent 1,453,385 fail to disclose the critical limitations of the instant invention.

A number of patents teach esterified ethoxylated glycerol compounds for various applications. These patents are Great Britian 1,453,385; Japan 59-1600 and Japan 58-206693 and European Patent Application 0586,323A1.These publications fail to appreciate that a mixture of esterified ethoxylated glycerol and nonesterified ethoxylated glycerol, when used in a hard surface cleaning composition, functions as a grease release agent.

SUMMARY OF THE INVENTION

In one aspect, the invention generally provides a stable, clear all-purpose, hard surface cleaning composition especially effective in disinfecting the surface being cleaned and in the removal of oily and greasy oil. The composition includes, on a weight basis:

- from 0.1% to 20% of an ethoxylated nonionic surfactant formed from the condensation product of a fatty alcohol and ethylene oxide or ethylene oxide and propylene oxide;
- 0 to 15%, more preferably 0.1% to 12% of a water soluble solvent;
- 0.4% to 1.0% of a perfume or water insoluble hydrocarbon;
- 0.25% to 8% of a disinfectant agent; and
- the balance of water, said proportions being based upon the total weight of the composition.

DETAILED DESCRIPTION OF THE INVENTION

The present invention relates to a stable hard surface cleaning composition approximately by weight: 0.1% to 20% of an ethoxylated nonionic surfactant formed from the condensation product of a fatty alcohol and ethylene oxide and other ethylene oxide and propylene oxide, 0 to 15%, more preferably 0.1% to 12% of a water soluble solvent; 0.1% to 1.0% of a water insoluble organic compound, essential oil, or a perfume, 0.25% to 8% of a disinfectant agent and the balance being water, wherein the composition does not contain an anionic surfactant which contains a carboxylate, sulfate or sulfonate group and the composition also does not contain an N-alkyl aldonamide surfactant, a trialkyl amine, an amine oxide surfactant, a water soluble organic or inorganic alkaline builder salt and/or cis/trans 2,6,6 trimethyl bicyclo (3,1,1) heptane.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc. The instant compositions show a marked improvement in ecotoxocity as compared to existing commercial products when mixture of a partially esterified ethoxylated polyhydric alcohol, a fully esterified ethoxylated polyhydric alcohol, and a nonesterified polyhydric alcohol (said mixture being herein after referred to as an ethoxylated glycerol type compound) are used as the nonionic detergent.

The water insoluble organic compound, essential oil or perfume is present in the composition in an amount of from 0.1% to 1.0% by weight, preferably from 0.4% to 0.8% by weight, especially preferably from 0.5% to 0.6% by weight, such as weight percent.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

The water insoluble saturated or unsaturated organic compound is selected from the group consisting of water insoluble hydrocarbons containing a cycloalkyl group having 5 to 10 carbon atoms, wherein the alkyl or cycloalkyl group can be saturated or unsaturated and the cycloalkyl group can have one or more saturated or unsaturated alkyl groups having 1 to 20 carbon atoms affixed to the alkyl or cycloalkyl group and one or more halogens, alcohols, nitro or ester group substituted on the cycloalkyl group or alkyl group; aromatic hydrocarbons; water insoluble ethers; water insoluble carboxylic acids, water insoluble alcohols, water insoluble amines, water insoluble esters, nitropropane, 2,5dimethylhydrofuran, 2-ethyl2-methyl 1,3dioxolane, 3-ethyl 4-propyl tetrahydropyran, N-isopropyl morpholine, alpha-methyl benzyldimethylamine, methyl chloraform and methyl perchlorapropane, and mixtures thereof. Typical hydrocarbons are cyclohexyl-1decane, methyl-3 cyclohexyl-9 nonane, methyl-3 cyclohexyl-6 nononane, dimethyl cycloheplane, trimethyl cyclopentane, ethyl-2 isopropyl-4 cyclohexane. Typical aromatic hydrocarbons are bromotoluene, diethyl benzene, cyclohexyl bromoxylene, ethyl-3 pentyl-4 toluene, tetrahydronaphthalene, nitrobenzene, and methyl naphthalene. Typical water insoluble esters are benzyl acetate, dicyclopentadienylacetate, isononyl acetate, isobornyl acetate and isobutyl isobutyrate. Typical water insoluble ethers are di(alphamethyl benzyl) ether, and diphenyl ether. A typical alcohol is phenoxyethanol. A typical water insoluble nitro derivative is nitro propane.

Suitable essential oils are selected from the group consisting of:

Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen, Allocimene, Arbanex™, Arbanol®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, Ferniol™, Florilys™, Geraniol, Geranyl Acetate, Geranyl Nitrile, Glidmint™ Mint oils, Glidox™, Grapefruit oils, trans-2-Hexenal, trans-2-Hexenol, cis-3-Hexenyl Isovalerate, cis-3-Hexanyl-2-methylbutyrate, Hexyl Isovalerate, Hexyl-2-methylbutyrate, Hydroxycitronellal, Ionone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo Ionone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, Tetralol®, Tomato oils, Vitalizair, Zestoral™, The at least one nonionic surfactant is present in amounts of about 0.1% to 15%, preferably 1% to 12% by weight of the composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 7 to 10 moles of ethylene oxide (Neodol 91-8) or a $C_9$–$C_{11}$ alkanol condensed with 5 moles of ethylene oxide (Neodol 91-5), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 8 contain less than 5 ethyleneoxide groups and tend to be poor emulsifiers and poor detergents.

An especially preferred nonionic system is a mixture of Neodol 91-8 and Neodol 91-5. Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described composition. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

Although all the above nonionic compounds are highly suitable, some of them do not deliver the right foam control and/or low enough ecotoxicity value. The present compositions can incorporate nonionic surfactants which are the condensation product of a $C_6$–$C_{10}$ alkanol with a heteric mixture of ethylene oxide and butylene oxide wherein the nonionic surfactant contains 6 to 10 moles of ethylene oxide and 1 to 3 moles of butylene oxide. These nonionic surfactants deliver outstanding foam control and have very good ecotoxicity value. These nonionics which are produced by DOW chemical are Polyglycol EB95-0779 and EB-0843/1.

The instant composition does not contain an ethoxylated glycerol type compound which is a mixture of a fully esterified ethoxylated polyhydric alcohol, a partially esterified ethoxylated polyhydric alcohol and a nonesterified ethoxylated polyhydric alcohol, wherein the preferred polyhydric alcohol is glycerol, and the compound is Formula (I)

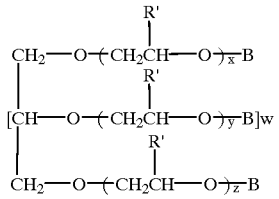

and

Formula (II)

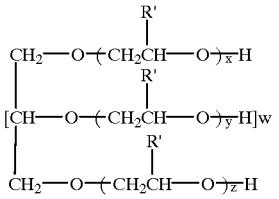

wherein w equals one to four, most preferably one. B is selected from the group consisting of hydrogen or a group represented by:

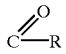

wherein R is selected from the group consisting of alkyl group having 6 to 22 carbon atoms, more preferably 11 to 15 carbon atoms and alkenyl groups having 6 to 22 carbon atoms, more preferably 11 to 15 carbon atoms, wherein a hydrogenated tallow alkyl chain or a coco alkyl chain is most preferred, wherein at least one of the B groups is represented by said

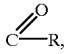

and R' is selected from the group consisting of hydrogen and methyl groups; x, y and z have a value between 0 and 60, more preferably 0 to 40, provided that (x+y+z) equals 2 to 100, preferably 4 to 24 and most preferably 4 to 19, wherein in Formula (I) the ratio of monoester/diester/triester is 45 to 90/5 to 40/1 to 20, more preferably 50 to 90/9 to 32/1 to 12, wherein the ratio of Formula (I) to Formula (II) is a value between 3 to 0.02, preferably 3 to 0.1, most preferably 1.5 to 0.2, wherein it is most preferred that there is more of Formula (II) than Formula (I) in the mixture that forms the compound.

The major class of compounds found to provide highly suitable water soluble solvent for the composition are water-soluble polyethylene glycols having a molecular weight of 150 to 1000, polypropylene glycol of the formula $HO(CH3CHCH2O)_nH$ wherein n is a number from 2 to 18, mixtures of polyethylene glycol and polypropyl glycol (Synalox) and mono and di $C_1$–$C_6$ alkyl ethers and esters of ethylene glycol and propylene glycol having the structural formulas $R(X)_nOH$ $R_1$ $(X)_nOH$ $R(X)_nOR$ and $R_1(X)_nOR_1$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1methoxy-2-propanol, 1methoxy-3-propanol, and 1methoxy 2-, 3- or 4-butanol.

Representative members of the polypropylene glycol include dipropylene glycol and polypropylene glycol having a molecular weight of 150 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tripropylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. These glycol type water soluble solvents are at a concentration of about 1.0 to about 14 weight %, more preferably about 2.0 weight % to about 10%. While all of the aforementioned glycol ether compounds provide the described stability, the most preferred cosurfactant compounds of each type, on the basis of cost and cosmetic appearance (particularly odor), is tripropylene glycol monobutyl ether Generally, amounts of water soluble solvents in the range of from 0 to 15%, preferably from about 0.1 wt. % to 12 wt. % provide stable compositions for the above-described levels of primary surfactants and water insoluble hydrocarbon and any other additional ingredients as described below.

The instant compositions contain about 0.25 to about 8 wt. %, more preferably 0.5 to 6 wt. % of a disinfectant agent selected from the group consisting of $C_8$–$C_{16}$ monoalkyl amines, $C_8$–$C_{16}$ alkyl benzyl dimethyl ammonium chlorides, $C_8$–$C_{16}$ dialkyl dimethyl ammonium chlories, $C_8$–$C_{16}$ alkyl, $C_8$–$C_{14}$ alkyl dimethyl ammonium chloride and chlorhexidine and mixtures thereof.

Some typical disinfectant agent useful in the instant compositions are manufactured by Lonza, S. A. They are: Bardac 2180 which is N-decyl-N-isonoxyl-N, N-dimethyl ammonium chloride; Bardac 22 which is didecyl dimethyl ammonium chloride; Bardac LF which is N, Ndioctyl-N, N-dimethyl ammonium chloride; Bardac 114 which is a mixture in a ratio of 1:1:1 of N-alkyl-N, N-didecyl-N, N-dimethyl ammonium chloride/N-alkyl-N, N-dimethyl-N-ethyl ammonium chloride; and Barquat MB-50 which is N-alkyl-N, N-dimethyl-N-benzyl ammonium chloride.

The final essential ingredient in the inventive compositions having improved interfacial tension properties is water. The proportion of water in the compositions generally is in the range of 20% to 97%, preferably 70% to 97% by weight of the usual diluted o/w composition.

In addition to the above-described essential ingredients, the compositions of this invention may often and preferably do contain one or more additional ingredients which serve to improve overall product performance.

The all-purpose liquid cleaning composition of this invention may, if desired, also contain other components either to provide additional effect or to make the product more attractive to the consumer. The following are mentioned by way of example: Colors or dyes in amounts up to 0.5% by weight, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the all-purpose liquids are clear compositions and exhibit stability at reduced and increased temperatures. More specifically, such compositions remain clear and stable in the range of 5° C. to 50° C., especially 10° C. to 43° C. Such compositions exhibit a pH in the acid or neutral range depending on intended end use. The liquid compositions are readily pourable and exhibit a viscosity in the range of 6 to 60 milliPascal second (mPas.) as measured at 250° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. It is not necessary to use elevated temperatures in the formation step and room temperature is sufficient.

The instant formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | A | B | C | D | E | F | G | H |
|---|---|---|---|---|---|---|---|---|
| Polyglycol nonionic EB95-0779 | 4 | 4 | 4 | 4 | 4 | 4 | 4 | 4 |
| Polyglycol nonionic EB96-0843/1 | 1 | 1 | 1 | 1 | 1 | 1 | 1 | 1 |
| Chlorohexidine diacetate | 1.5 | | | | | | | |
| Chlorohexidine digluconate | | 1.5 | | | | | | |
| Alkylamine | | | 1.5 | | | | | |
| Didecyldimethyl ammonium chloride | | | | 1.5 | | | | |
| 50% Bardac 22 plus 50% Barquat MB-50 | | | | | 1.5 | | | |
| Bardac 2180 | | | | | | 1.5 | | |
| $C_{12}$–$C_{16}$ alkyl dimethyl benzyl ammonium chloride | | | | | | | 1.5 | |
| Perfume | 0.5 | 0.5 | 0.5 | 0.5 | 0.5 | 0.5 | 0.5 | 0.5 |
| Tripropylene glycol N-butyl ether | 2.5 | 2.5 | 2.5 | 2.5 | 2.5 | 2.5 | 2.5 | 2.5 |
| Water | Bal. | Bal. | Bal. | Bal. | Bal. | Bal. | Bal. | Bal. |
| Disinfecting results | | | | | | | | |
| 50% dilution in water | Pass | Pass | Pass | Pass | Pass | Pass | Pass | Fail |
| 2% dilution in water | Pass | Pass | Pass | Pass | Pass | Pass | Pass | Fail |
| Degreasing test | | | | | | | | |
| Neat | Good | Good | Good | Good | Good | Good | Good | Good |
| Dilute | Good | Good | Good | Good | Good | Good | Good | Good |

The test protocol used to assess disinfection is the well known French AFNOR Norm 72-151 which uses four different strains of bacteria, a short contact time and calls for a bacteria count reduction of 5 log.

In summary, the described invention broadly relates to an improved composition containing at least one nonionic surfactant and/or a water soluble solvent, a hydrocarbon ingredient, a disinfectant agent and water.

What is claimed:

1. A cleaning composition comprising:

(a) 0.1 wt. % to 20 wt. % of at least one nonionic surfactant which is a condensation product of a $C_6$–$C_{10}$ alkanol with a heteric mixture of ethylene oxide and butylene oxide, wherein the nonionic surfactant contains 6 to 10 moles of ethylene oxide and 1 to 3 moles of butylene oxide;

(b) 0.25 wt. % to 8 wt. % of a disinfectant agent selected from the group consisting of $C_8$ to $C_{16}$ monoalkyl amine, $C_8$ to $C_{16}$ alkyl benzyl dimethyl ammonium chloride, $C_8$ to $C_{16}$ dialkyl dimethyl ammonium chloride and chorohexidine;

(c) 0.1 wt. % to 12 wt. % of a water soluble glycol ether solvent;

(d) 0.1 wt. % to 1.0 wt. % of a water insoluble hydrocarbon, essential oil or a perfume; and (e) the balance being water, wherein the composition does not contain an anionic surfactant which contains a carboxylate, sulfate or sulfonate group and the composition also does not contain an N-alkyl aldonamide surfactant, a trialkyl amine, an amine oxide surfactant, a water soluble organic or inorganic alkaline builder salt and/or cis/trans 2,6,6 trimethyl bicyclo (3,1,1) heptane.

2. The cleaning composition of claim 1 which contains from 0.4% to 0.8% by weight of said hydrocarbon, perfume or essential oil.

3. The cleaning composition of claim 1 wherein the glycol ether is selected from the group consisting of ethylene glycol monobutyl ether, diethylene glycol monobutyl ether, triethylene glycol monobutyl ether, polypropylene glycol having an average molecular weight of from 150 to 1,000 and propylene glycol tertiary-butyl ether, mono, di, tri propylene glycol monobutyl ether.

4. The cleaning composition of claim 3 wherein the glycol ether is ethylene glycol monobutyl ether or diethylene glycol monobutyl ether.

* * * * *